United States Patent [19]

Parsons et al.

[11] Patent Number: 4,955,518

[45] Date of Patent: Sep. 11, 1990

[54] BATON CLIP FOR EXPANDABLE BATONS

[76] Inventors: Kevin L. Parsons, 16 Wagon Wheel Dr., Appleton, Wis. 54915; Gary M. Grundy, 921 E. Hamilton St., Milwaukee, Wis. 53201; Jacqueline M. Dunstan, 604 Aspen St., South Milwaukee, Wis. 53172

[21] Appl. No.: 332,299

[22] Filed: Mar. 31, 1989

[51] Int. Cl.[5] ..... A45F 5/00

[52] U.S. Cl. ..... 224/247; 224/251; 224/253; 224/914

[58] Field of Search ..... 224/193, 197, 200, 231, 224/247, 250, 251, 253, 914, 35; 273/84 R

[56] References Cited

U.S. PATENT DOCUMENTS

| | | | |
|---|---|---|---|
| 162,055 | 4/1875 | Goss | 224/251 X |
| 372,000 | 10/1887 | Wintz | 224/914 X |
| 710,236 | 9/1902 | Audley | 224/914 X |
| 755,009 | 3/1904 | Igel | 224/250 |
| 969,524 | 9/1910 | Condon | 224/253 X |
| 2,781,958 | 2/1957 | Lewandewski | 224/251 X |
| 3,596,964 | 8/1971 | Zazzara | 224/251 X |
| 3,637,120 | 1/1972 | Clay | 224/251 X |
| 4,006,851 | 2/1977 | Kippen | 224/914 X |
| 4,286,741 | 9/1981 | Rogers | 224/193 |

*Primary Examiner*—Henry J. Recla
*Assistant Examiner*—R. M. Fetsuga
*Attorney, Agent, or Firm*—Quarles & Brady

[57] ABSTRACT

A baton holder, or clip, is particularly adapted for use with expandable batons or the type including a handle and one or more telescoping sections. The clip includes upper and lower retaining rings attached to a base member. The upper retaining ring slidably receives the handle. The lower retaining ring is a truncated conical section, which limits downward axial movement of the handle, while at the same time allowing passage of the telescoping sections from the handle, if extended. The expandable baton is held by the clip in either an extended or retracted position. Both the upper and lower retaining rings include longitudinal breaks, through which the baton may be broken out laterally, again with the baton either extended or retracted.

4 Claims, 3 Drawing Sheets

BATON CLIP FOR EXPANDABLE BATONS

BACKGROUND OF THE INVENTION

The field of the invention is baton holders, or clips, and more particularly, baton clips for holding expandable batons.

Baton holders, or clips, for fixed length, rigid batons, or "night sticks" are known which allow the baton to be deployed laterally, or "broken out" as it is referred to in the art. Examples of such lateral draw clips are shown in U.S. Pat. Nos. 372,000; 710,236; 969,524; and 4,006,851. Lateral draw clips may employ a closure means in the form of a strap or clasp which prevents the baton from being broken out until the closure means has been released. The closure means thereby prevents the baton from being released from the clip inadvertently, or from being "grabbed away" by an adversary. The aforementioned U.S. Pat. Nos. 710,236 and 4,006,851 include such closure means.

While "break out" baton clips have generally been known and used for standard, fixed length batons, the use of such clips for expandable batons has been precluded due to the unique characteristics of expandable batons. Specifically, the handle on most expandable batons does not include the "stopper", or other change in baton diameter, used on full length batons to prevent the baton from falling through the clip. Also, the problem of falling through prior clips is exacerbated by the fact that expandable batons are much shorter, when retracted, than full length batons, and smaller in diameter. Further, the handles of expandable batons are usually padded to provide a secure grip. Clips which rely solely on friction, or "pinching" the baton shaft cannot securely retain such padded handles without excessive force, and may damage the handle padding.

The most common carrier used for expandable batons is a simple accessory case, e.g. a "pocket" type carrier usually made of leather and attachable to a wearer's belt. Such a carrier is described in co-pending U.S. Patent Application No. 07/207,820, filed June 16, 1988. While the accessory case type carriers are acceptable in many applications, other applications present requirements which render accessory cases unsuitable. Specifically, it is sometimes required to draw the expandable baton laterally, and sometimes necessary to stow the baton in the extended position.

The known accessory cases and baton clips cannot accommodate the requirements peculiar to expandable batons, and so a need exists for a lateral draw baton clip capable of stowing, and allowing lateral break out, for an expandable baton in either the retracted or extended positions.

SUMMARY OF THE INVENTION

Accordingly, an object of the present invention is to provide a baton clip particularly adapted for use with an expandable baton. A baton clip according to the invention includes a base member and retaining means attached to the base member. The retaining means includes upper guide means and lower guide means. The upper guide means is adapted to slidably receive a handle of the expandable baton, and to provide a first resistance to lateral movement of the handle. The upper guide means further includes a first longitudinal break which allows the first resistance to lateral movement to be overcome by an application of a lateral force on the handle. Upon such application of the lateral force, the expandable baton is broken out through the first longitudinal break.

The lower guide means is adapted to receive an end of the expandable baton handle, with the lower guide means being mated to the handle end such that when the handle end is in contact with the lower guide means, the lower guide means provides both a second resistance to lateral movement of the handle and a third resistance to downward movement of the handle. The lower guide means also includes an aperture which allows a telescoping member of the expandable baton extending from the handle end to pass downward through the aperture. The lower guide means further includes a second longitudinal break whereby the second resistance to lateral movement is also overcome by the application of the lateral force on the handle. Again, upon application of the lateral force, the expandable baton is broken out through the second longitudinal break.

As a result of the above described construction, the clip according to the invention is adapted to both hold, and allow the lateral break out, of the expandable baton with the expandable baton in both a retracted position in which the telescoping member is nested inside the handle, and in an extended position in which the telescoping member is extended outside of the handle.

One advantage of the clip according to the invention is that the expandable baton may be carried in the clip in the retracted position, thereby providing a compact size and ease of movement for the wearer. If it is necessary to withdraw the baton, it may be quickly deployed by breaking the baton out laterally. Once extended, the baton may be replaced in the clip, still in the extended position, if it is not possible or convenient to retract the baton. Further, should a need arise to draw the baton from the clip in the extended position, the clip still provides a lateral draw capability, even with the baton in the extended position.

Another advantage of the clip according to the invention is simplicity of construction.. The upper guide means and the lower guide means may be formed separate retaining rings, hereby providing a lightweight case using a minimum of material.

Another object of the invention is to positively secure the expandable baton. The clip may include closure means movable between fastened and released positions, in order to prevent lateral breakout of the expandable baton when the closure means is in the fastened position.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
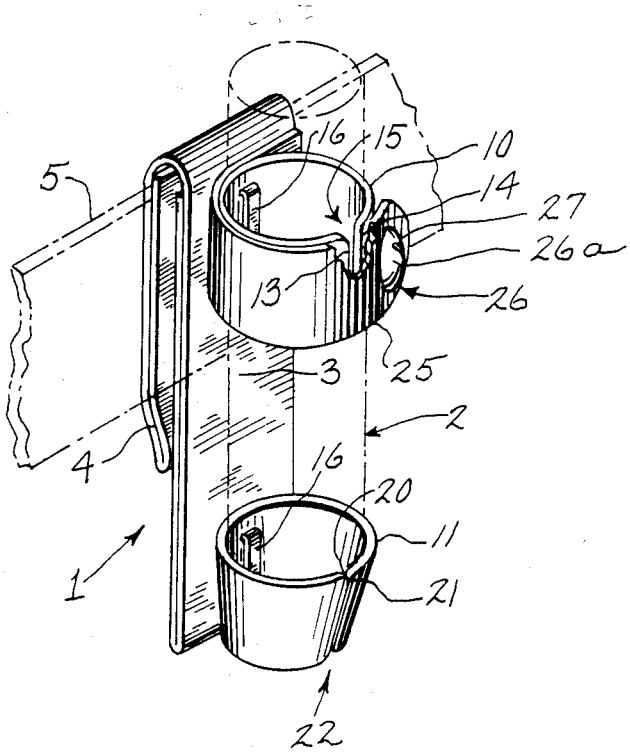
FIG. 1 is a perspective view of a baton clip for an expandable baton according to the present invention.
Figure 2:
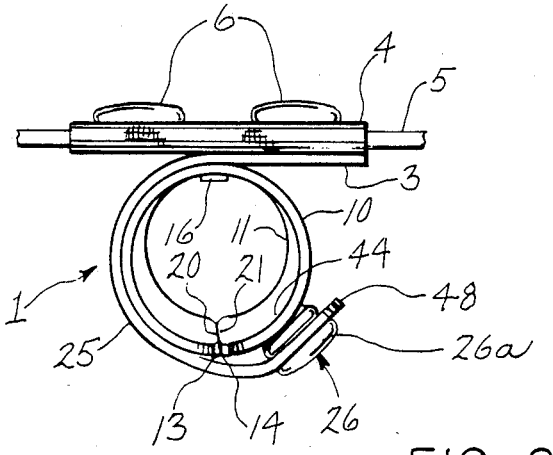
FIG. 2 is a top view of the baton clip of FIG. 1.

Referring to FIGS. 1 and 2, a baton holder, or clip 1 is specifically adapted for holding an expandable baton 2. In the illustrated embodiment, the expandable baton 2 is of the type comprising a cylindrical outer section which serves as a handle 7. The handle 7 may include a layer of padding material 8 to serve as a grip. One or more telescoping cylindrical sections 9 are nested inside the handle 7 in a retracted position, and are extendable to lock in an extended position. An example of such a construction for an expandable baton 2 is described in co-pending U.S. Patent Application No. 07/255,078, filed Oct. 7, 1988.

The clip 1 includes a backing, or base member 3. As illustrated in FIG. 1, the base member 3 may include means for attaching to the belt 5 of a user, for example, by using an attachment strap 4. Other known means for attaching holsters, accessory cases, and other similar articles such as, for example, snaps for directly snapping onto the user's belt 5, are equally usable with his invention.

An upper retaining ring 10 is attached on the upper end of the base member 3 by means of a staple 16. A lower retaining ring 11 is also attached to the base member 3 with a staple 16, and is disposed in axial alignment beneath the upper retaining ring 10. A closure strap 25 extends from the base member 3, around the front of the upper retaining ring 10, and terminates in the outer rear quadrant of the retaining ring 10.

The closure strap 25 is releasably secured to the upper retaining ring 10 by means of a unidirectional snap assembly 26 comprised of two snap halves 26*a* and 26*b*. Unidirectional snaps of the type used in this embodiment are generally known in the art, and are releasable only by the application of force to separate the snap halves at a release point, usually indicated by a dimple 27 or other mark on the cap, or female snap half 26*a*.

The retaining rings 10 and 11 are formed of a stiffly resilient, or spring material. In this particular embodiment, the material preferred for the retaining rings 10 and 11 is a thermo-settable plastic material known in the art under the trade name "KYDEX". The KYDEX material is preferred because it can be easily formed to the desired shape using known thermo setting methods. The KYDEX retaining rings 10 and 11 also possess other qualities which are beneficial in meeting the objectives of this invention, as described in detail below.

The upper retaining ring 10 is generally in the form of a right circular cylinder which includes two longitudinal edges 13 and 14 to define a longitudinal break 15. The diameter of the upper retaining ring 10 is sized such that with the closure snap 26 fastened, the baton 2 may be inserted or withdrawn axially through the retaining ring 10. Preferrably, a snug fit is formed between the handle and the retaining ring 10 to hold the baton 2 firmly, e.g. restrain lateral movement, yet permitting axial movement. The layer of padding 8 on the handle 7 is somewhat deformable to allow movement within the ring 10 while at the same time maintaining the snug fit.

The lower retaining ring 11 includes longitudinal edges 20 and 21, defining a second longitudinal break 22, but is in the form of a truncated conical section, e.g. tapering from a larger diameter top opening to a smaller diameter bottom opening. The larger diameter of the conical section faces upwards, towards the upper retaining ring 10, and is approximately the same diameter as that of the upper retaining ring 10. The smaller diameter, which faces downwards with respect to the upper retaining ring 10, is smaller than the outer diameter of the baton handle 7, but larger than the outer diameter of the largest telescoping member 9 nested inside the handle 7. In that way, downward axial movement of the handle 7 is resisted by the lower retaining ring 11, while the telescoping members 9, if extended, are allowed to pass through the ring 11. This is an important operational feature of the present invention, which is described in detail below.

The end of the handle 7 from which the telescoping members 9 issue is usually somewhat rounded, or tapered. The truncated conical shape of the lower retaining ring 11 is therefore adapted receive the tapered handle end, inhibiting lateral and downward axial movement thereof. It should be apparent to those skilled in the art other shapes other that a rounded taper are possible for the handle end, and that such shapes could be accommodated by suitable corresponding modifications to the lower retaining ring 11. The only requirements are that the lower retaining ring 11; (a) include a longitudinal break 22, (b) resist downward axial movement of the baton handle 7, and (c) allow telescoping sections 9 issuing from the handle 7 to pass through. The illustrated truncated conical shape is preferred in that it is compatible in achieving the above objectives in conjunction with a tapered handle end, and is easily formed from a flat piece of material cut to two different radii as is well known in the art.

In summary, the handle 7 of the baton 2 may be inserted through the upper retaining ring 10 until contact is made between the tapered end of the handle 7 and the lower retaining ring 11. At that point, further downward axial movement is resisted, and the baton is held secure at two points, e.g. both the upper and lower retaining rings 10 and 11, respectively. Thus inserted, and with the closure snap 26 fastened, only upward axial movement is accommodated, e.g. to withdraw the baton 2 axially.

With the closure snap 26 released, the baton 2 may also be withdrawn laterally, or "broken out" to the side of the clip 1 through the longitudinal breaks 15 and 22, as described in detail below. In the above discussion regarding the ability of the lower retaining ring 11 to restrain downward axial movement of the handle 7, it has been assumed that an excessive force capable of ramming the handle 7 through the ring 11 by spreading open the longitudinal break 22 is not to be applied. The resistance provided by the lower retaining ring 11 against such an abnormal movement is substantial and could only be overcome by deliberate abuse.

Figure 3:
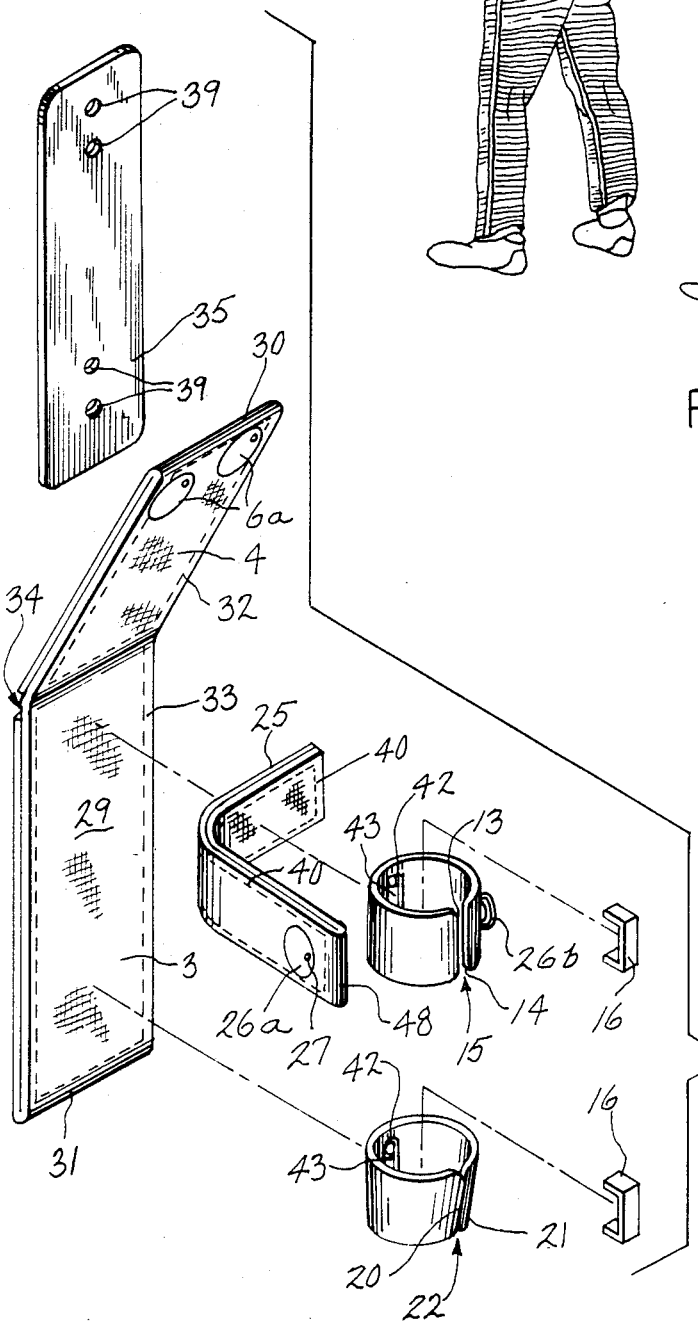
FIG. 3 is an exploded perspective view illustrating the assembly of the baton clip of FIG. 1.

Before describing the advantageous operational features of the clip 1, the unique structural details of the clip 1 are now described, primarily in relation to FIG. 3.

In FIG. 3, a preferred construction for the clip 1 is shown as comprising a rectangular strip of heavy woven nylon fabric 29, or other suitable material, folded at 30 and 31 to integrally form the base member 3 and the attachment strap 4. The nylon material 29 is preferred because the expandable batons for which the clip 1 is intended to be used are often employed in applications where the more common leather material is not practical, for example, in ship borne applications and other harsh environments. Environment permitting, leather may of course be used as an alternative, as well as other known materials.

The folded nylon material 29 is sewn as shown at 32 and 33 to form a double thickness of fabric. The stitching 33 leaves the top of base member 3 open, thereby forming a pocket 34. A stiff backing material 35 is inserted into the pocket 34 providing stiffness and rigidity for the base member 3. The closure strap 25 is also preferably a sewn double thickness strip of woven nylon fabric. One end of the closure strap 25 is secured to the base member 3 by stitching 40. The cap 26*a* for snap 26 is set near the other, or terminal end of closure strap 25. Also, the caps 6*a* for snaps 6 are set onto one end of the the attachment strap 4. The mating studs (not shown) for the snaps 6 are set through the nylon fabric 29 before sewing, so that the studs abut against the backing plate 35 once the later is inserted into the pocket 34.

Still referring to FIG. 3, the retaining rings 10 and 11 are formed before joining to the base member 3 as follows. As mentioned above, the preferred material for the rings 10 and 11 is a thermo-settable resilient plastic known in the art under the trade name "KYDEX". The KYDEX material is manufactured as flat sheets (not shown). Flat shapes (not shown) which are to be formed into the rings 10 and 11 are cut from the sheet into shapes appropriate for forming the rings 10 and 11, e.g. a rectangular strip to form ring 10 and a curved strip with different radii to form the ring 11. A preferred thickness for the KYDEX used in forming the rings 10 and 11 is approximately 3/32 of an inch.

As stated above, the diameter of the rings 10 and 11 is dependent on the diameter of the baton shaft 1. A common shaft diameter for the expandable baton handle 2 is nominally 1 1/16 inch, and may taper slightly towards the tip. In that case an inside diameter for the ring 10 in a relaxed, or un-tensioned state, of about the same 1 1/16 inch would provide the desired snug fit. The corners of the flat shapes are then rounded off so that once the rings 10 and 11 are formed, the corners for the longitudinal breaks 15 and 22 are smoothly rounded to facilitate sideways break-out of the baton 2 without marking.

With the KYDEX shapes still flat, two holes are formed in each ring 10 and 11 to receive the staples 16 (one such hole 42 in each ring 10 and 11 being visible in FIG. 3). Recesses 43 are formed in the rings 10 and 11 to sink the body of the staples 16 so as not to obstruct movement of the baton handle 7. Mating holes 39 may be formed in the backing plate 35 to facilitate the stapling operation. Ring 10 is formed with one additional hole to receive a rivet 44 for attaching the stud 26*b*. A counterbore (not shown) is formed to recess the head of the rivet 44, thereby reducing abrasion on the baton handle 7. In actuality, the head of the rivet 44 may protrude slightly, once the ring 10 is formed, as seen in FIG. 2. However interference with the baton handle 7 is minimal. The recess for the rivet 44 also facilitates setting of the stud 26*b* while the KYDEX piece is flat, without interfering with the forming of the KYDEX into the ring 10.

After forming the holes 42 and recesses 43, and setting the stud 26*b*, the KYDEX shapes are formed into the rings 10 and 11. The process for thermo-forming KYDEX is generally known in the art, and comprises the steps of (1) heating the KYDEX until it softens, and then (2) forming the KYDEX into the desired shape. In this case, to form the ring 10, a cylindrical post (not shown) is used as a mold around which the softened KYDEX is held until cooled. An outer hollow cylindrical metal mold (not shown) may be advantageously used for holding the KYDEX tightly around the post, which also serves as a heat sink for accelerating the cooling process. Similarly, a conical post and mating outer mold (also not shown) may be used to form the ring 11.

The KYDEX material has the characteristic of shape "memory"; it retains the form in which it is thermo-set. Then when cooled, the KYDEX is essentially an elastic spring, allowing deformation against a tension supplied by the KYDEX. When released, the KYDEX restores to its programmed shape. The formation and the resulting shape of the rings 10 and 11 are important parts of this invention, as has been described above. Once formed, the rings 10 and 11 are stapled onto the base member 3. The attachment and closure straps 4 and 25, respectively, can then be folded and secured via their respective snaps 6 and 26, as shown in FIGS. 1 and 2.

As mentioned above, the clip 1 allows the baton 2 to be "broken out" by forcing the baton 2 sideways through the longitudinal breaks 15 and 22. One important feature of the clip 1 is the production of a loud snapping noise when the baton 2 is broken out, as described in our co-pending U.S. Patent Application No. 332,237, Filed Mar. 31, 1989, and entitled BATON CLIP, the contents of which are herein incorporated by reference.

Figure 4:
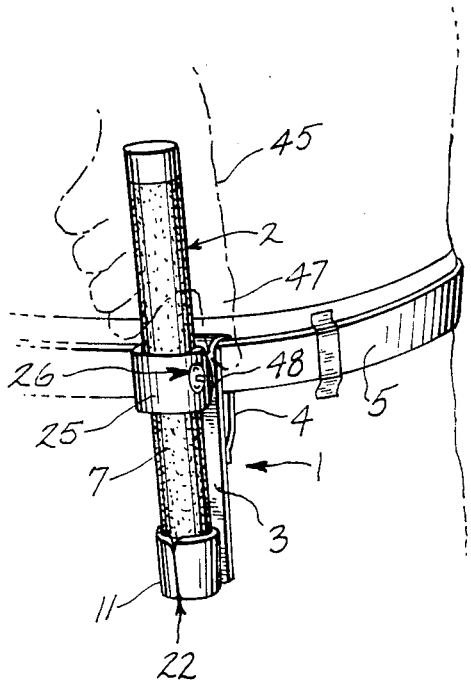
FIGS. 4 and 5 are a time sequence series of side views illustrating the operation of breaking the expandable baton out of the baton clip of FIG. 1, with the expandable baton in a retracted position.

Having described a preferred construction for a clip 1 according to the invention, the advantageous operational features of the clip 1 are now described. Referring to FIG. 4, a user's hand 45 is poised at the beginning of the withdrawal motion. The expandable baton 2 and clip 1 are normally worn on the left side, since most people are right handed and batons are usually carried by security or law enforcement personnel who also carry a firearm on their right side. With full length batons, a left hand draw is customarily used for a left side mounted baton. However, for reasons detailed below, a right handed, or "cross draw" is preferred for expandable batons. The hand 45 illustrated is therefore the right hand, although it should be apparent that a mirror image construction would enable corresponding left hand use.

In the FIG. 4 position, it should be noted that the closure snap 26 is fastened. As the user's hand 45 grasps the baton 2, the user's thumb 47 naturally falls under the terminal end 48 of the closure strap 25. Again for reasons which are made clear below, the preferred direction for breaking out the expandable baton 2 is straight sideways, not frontward as is normally the case with full length batons. The hand 45 therefore begins to move outwardly, and in doing so releases the closure snap 26 by prying out on the terminal end 48 of the closure strap 25.

Figure 5:
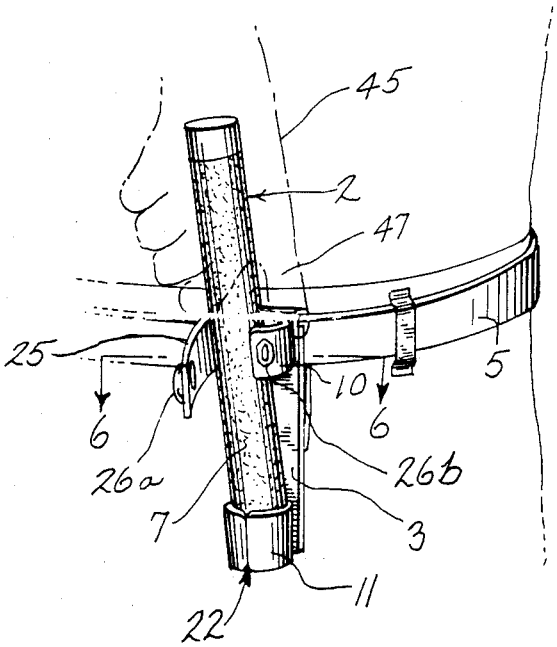
Figure 6:
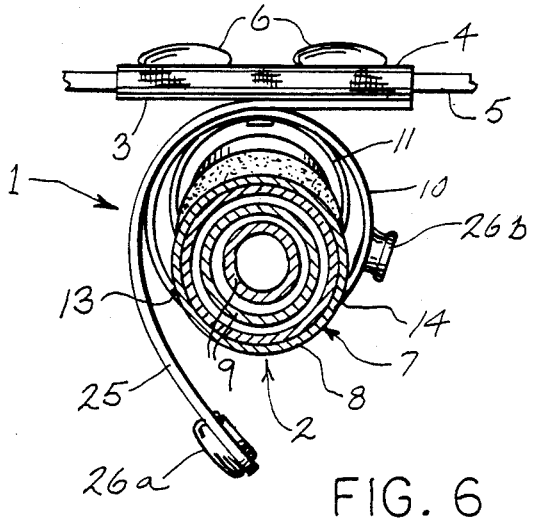
FIG. 6 is a sectional view taken on line 6—6 of FIG. 5.

With the closure strap 25 released, lateral, or sideways movement of the baton 2 forces open the longitudinal break 15 in the upper retaining ring 10 to reach the position as shown 2 in FIGS. 5 and 6. It should be noted that in FIG. 5, the baton in the retracted position, and so the lower retaining ring 11 acts primarily as a pivot. Although some spreading of the longitudinal break 22 may be possible, the retracted baton 2 is essentially lifted out of the lower retaining ring 11. The main purpose of the longitudinal break 22 in the lower retaining ring 11 is to allow the breaking out of an extended baton 2 as described below.

Figure 7:
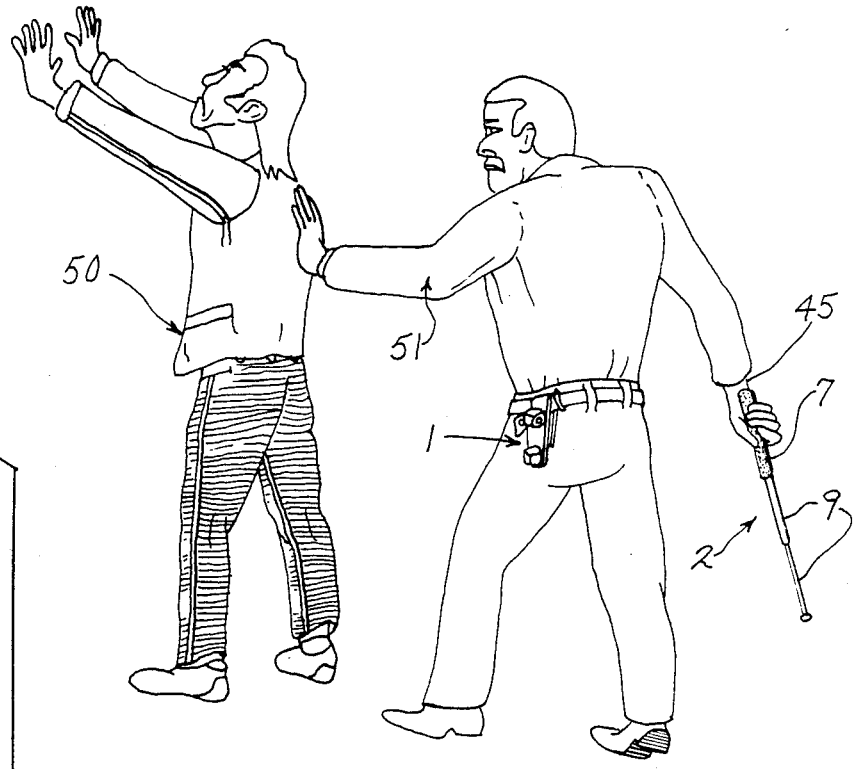
FIG. 7 is view illustrating the extension and use of the expandable baton subsequent to breaking out the expandable baton in the retracted position from the baton clip of FIG. 1.

As is known in the art, expandable batons are usually extended by sharply swinging the baton 2 in an arc. After having broken the baton 2 out sideways with a right hand cross draw, as shown in FIGS. 4–6, the user is in an ideal position to sharply swing the right arm back across the body, extending the baton 2 while at the same time assuming an advantageous defensive posture, as illustrated in FIG. 7. Now, with the baton extended, a subject 50 may be subdued.

Having brought the subject 50 under control, it is usually then necessary to apply manacles (not shown). One arm, i.e. left arm 51, must remain in contact with the subject 50 while the manacles are being applied, lest the subject 50 attempt to attack or flee. Therefore, the baton 2 in the right hand 45 must be temporarily set aside. It is not acceptable to merely lay the baton 2 down, as it could then be kicked away, grabbed by another party, or roll away if the user is on a ship or other moving vehicle, or simply on terrain which does not permit.

Figure 8:
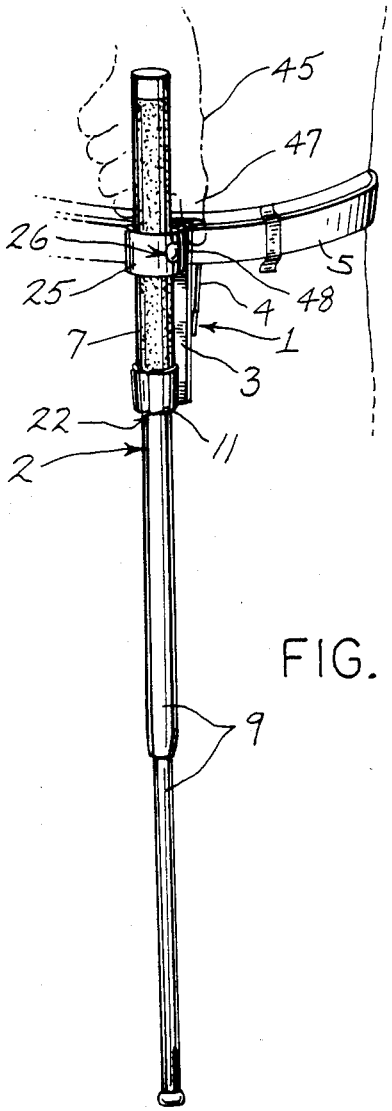
FIGS. 8–9 are a time sequence series of side views illustrating the operation of stowing the extendable baton in an extended position in the baton clip of FIG. 1, and breaking out the expandable baton in the extended position from the baton clip of FIG. 1.

The clip 1 according to this invention allows the baton 2 to be placed back in the clip 1 even while in the extended position, as seen in FIG. 8. The extended baton 2 is inserted axially, down through the retaining rings 10 and 11. Because the lower retaining ring 11 has a smaller diameter which is larger than that of the telescoping sections 9 of the baton 2, the telescoping sections 9 are able to pass through freely. However, the handle 7 of the baton 2, having a diameter greater than the smaller opening in the lower retaining ring 11, eventually contacts with the lower retaining ring 11, and further downward axial movement is resisted. The baton 2 is then held securely by both the upper and lower retaining rings 10 and 11.

Also note that because of the above described slidable fit between the baton handle 7 and the upper retaining ring 10, the insertion of the baton, extended or not, can be accomplished even with the closure strap 25 fastened. The ability to accommodate an extended baton is an important part of this invention, as the need to replace the baton 2 in the extended position can arise from many circumstances other than the above described confrontation scenario. For example, extendable batons often use "dead lock taper" joints to hold the baton extended. To retract the telescoping sections, it is necessary to strike a sharp axial blow with the tip of the innermost telescoping section on a hard surface, such as concrete. Depending upon the environment in which the baton is deployed, a suitable surface for closing the baton may not be available, and the baton must be carried pro tem in the extended position. One particular instance of the forgoing situation occurs in the case of law enforcement officers acting on private property, for example, in the case of boarding boats at sea. The officers would be precluded from striking the baton on the private property as it could cause property damage. The clip 1 according to the invention is particularly advantageous in such situations.

Figure 9:
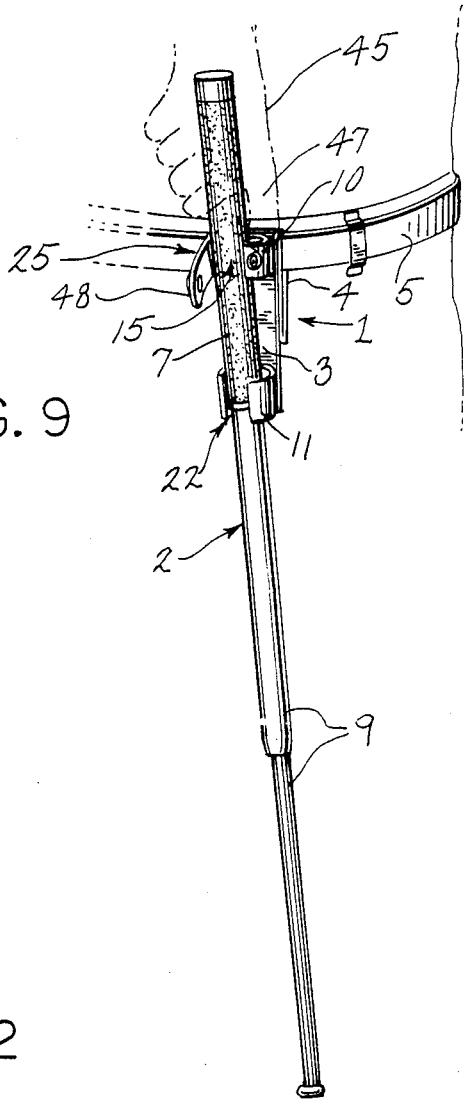

Referring again to FIG. 8, after the baton 2 in the extended position has been placed in the clip 1, it may become necessary to immediately re-deploy the baton 2. Resuming the above sequence involving the subject 50, the subject 50 may begin to struggle once the baton 2 has been put away, prompting the user to again draw the already extended baton 2. A unique feature of the clip 1 according to the present invention is the clip 1 is adapted to allow the baton 2 to be rapidly broken out laterally even in the extended position. In FIG. 8, the user's right hand 45 grasps the handle 7 for a cross draw removal, the same as described above in relation to FIG. 4. Again, outward movement of the hand 45 releases the closure snap 26 (if fastened). Now, referring to FIG. 9, both longitudinal breaks 15 and 22 are forced open, as the handle 7 and the telescoping sections 9 pass laterally therethrough, respectively. The reason for the preferred sideways orientation of the longitudinal breaks 15 and 22 can now be explained. Because of the separation between the upper and lower retaining rings 10 and 11, a torque is introduced as the baton 2 is tipped, or levered outwardly to break it out. With the longitudinal breaks 15 and 22 oriented sideways, that torque tends to be reacted against the belt and thigh of the wearer, rather than causing twisting of the clip 1. Orientations other than straight sideways for the longitudinal breaks 15 and 22 are still contemplated by this invention, although the aforementioned twisting of the case 1 may occur when breaking out an extended baton 2.

We claim:

1. A baton clip for an expandable baton of the type including a handle and at least one telescoping member, the telescoping member being movable between a retracted position in which the telescoping member is contained substantially within a hollow interior of the handle and an extended position in which the telescoping member issues from an open end of the handle, the baton clip comprising:

a bas member;

retaining means attached to the base member, the retaining means including;

upper guide means formed of a resilient material having a first neutral shape which is adapted to slidably receive the handle of the expandable baton, and to provide a first resistance to lateral movement of the handle, the upper guide means including a first longitudinal break whereby the first resistance to lateral movement may be overcome by an application of a lateral force on the handle to temporarily deform the upper guide means and break the expandable baton out through the first longitudinal break, whereupon after the break out of the expandable baton, the upper guide means restores to said first neutral shape;

lower guide means formed of a resilient material having a second neutral shape which is adapted to receive the open end of the expandable baton handle, the lower guide means being mated to the open end of the handle such that when the open end of the handle is in contact with the lower guide means, the lower guide means provides both a second resistance to lateral movement of the handle and a third resistance to downward movement of the handle, the lower guide means including an aperture which allows the telescoping member to pass downward through the aperture when the telescoping member is in the extended position, and the lower guide means including a second longitudinal break whereby the second resistance to lateral movement is also overcome by the application of the lateral force on the handle to temporarily deform the lower guide means and break the expandable baton out through the second longitudinal break, whereupon after the break out of the expandable baton, the lower guide means restores to said second neutral shape;

wherein the baton clip is adapted to both hold, and allow the lateral break out, of the expandable baton with the expandable baton in both the retracted position and the extended position.

2. The baton clip as recited in claim 1 in which the upper guide means and the lower guide means are separate retaining rings.

3. The baton clip as recited in claim 2 in which the expandable baton handle and the telescoping member have circular cross sections, and in which the lower guide means retaining ring is generally shaped as a truncated conical section, with a smaller end of the truncated conical section being directed downward and having a diameter which is smaller than the diameter of the handle and larger than the diameter of the telescoping member.

4. The baton clip as recited in claim 1 which includes closure means movable between a fastened position covering the longitudinal break of the upper guide means and a released position clear of the longitudinal break of the upper guide means, wherein the expandable baton is substantially restrained from being broken out laterally when the closure means is in the fastened position.

* * * * *

UNITED STATES PATENT AND TRADEMARK OFFICE

CERTIFICATE OF CORRECTION

PATENT NO. : 4,955,518

DATED : September 11, 1990

INVENTOR(S) : Kevin L. Parsons et al.

It is certified that error appears in the above-identified patent and that said Letters Patent is hereby corrected as shown below:

In Column 7,
at Line 2, change "shown 2 in" to --shown in--.

In Column 7,
at Line 3, change "baton" to --baton 2--.

In Claim 1,
at Line 39, Change "bas" to --base--.

Signed and Sealed this

Twenty-second Day of January, 1991

*Attest:*

HARRY F. MANBECK, JR.

*Attesting Officer*

*Commissioner of Patents and Trademarks*